US005111978A

United States Patent [19]

Mengeu

[11] Patent Number: 5,111,978

[45] Date of Patent: May 12, 1992

[54] FITMENT RETAINED IN CONTAINER CLOSURE

[75] Inventor: Gary L. Mengeu, Wheeling, W. Va.

[73] Assignee: Continental Plastics, Inc., Triadelphia, W. Va.

[21] Appl. No.: 652,793

[22] Filed: Jan. 16, 1991

[51] Int. Cl.[5] ..... B65D 47/00

[52] U.S. Cl. ..... 222/545; 222/570; 215/321; 215/350

[58] Field of Search ..... 215/320, 321, 350, 277; 222/545, 546, 565, 562, 570

[56] References Cited

U.S. PATENT DOCUMENTS 2,547,590 4/1951 McGinnis .
2,696,318 12/1954 Kihm .
3,339,772 9/1967 Miller .
3,823,841 7/1974 Lovejoy .
4,076,152 2/1978 Mumford .
4,187,964 2/1980 Bogart .
4,433,800 2/1984 Owens .
4,475,274 10/1984 Beckstrom et al. ..... 222/545
4,494,682 1/1985 Beckstrom et al. ..... 222/570
4,717,034 1/1988 Mumford ..... 215/350
4,773,552 9/1988 Boege et al. .

*Primary Examiner*—H. Grant Skaggs
*Attorney, Agent, or Firm*—Richard V. Westerhoff

[57] ABSTRACT

A dispensing fitment is temporarily retained in a conventional screw cap for application to a container as an assembly by axial ribs extending radially outward from the cylindrical sidewall of the fitment to engage the cap threads, and by thin planar fins extending radially outward from the base of each rib parallel to the end wall of the fitment and into the cap thread. An internal bead on the fitment snaps over an external groove in the container neck to secure the fitment to the container so that the fitment remains affixed to the container when the cap is removed for dispensing product from the container through a dispensing opening in the fitment end wall.

8 Claims, 2 Drawing Sheets

FITMENT RETAINED IN CONTAINER CLOSURE

BACKGROUND

1. Field of the Invention

This invention is directed to container dispensing fitments which are retained in a cap until applied to a container, but which then remain with the container for dispensing the contents of the container when the cap is removed.

2. Background Information

Many containers are provided with fitments for dispensing the contents of the containers. These fitments may have variously configured openings such as a single aperture for dispensing drops of liquid from the container, a slot for pouring, or a plurality of apertures for shaking out liquid or granular product from the container.

Typically, the fitment snaps into engagement with the container opening and a removable cap is applied over the fitment for sealing the container for shipment and between uses. Conventionally, separate operations have been required to install the fitment and then the cap on the filled container.

In order to eliminate the necessity for two distinct assembly steps, fitment-closure combinations have been developed in which the fitment is temporarily retained within the closure so that they may be applied to the container as an assembly in one operation. Examples of such fitment-closure combinations are disclosed in U.S. Pat. Nos. 2,696,318; 3,339,772; 4,076,152; 4,187,964 and 4,433,800. However, the closures used in these assemblies must have special features adapted to temporarily retain the fitment. Another difficulty is adequately securing the fitment in the closure to withstand shocks to which the assembly is exposed in the capping operation. Often the assemblies are dumped into a bin and subject to other forms of rough handling such as transport by a pneumatic system, all of which tend to dislodge the fitment from the closure. On the other hand, the fitment cannot be retained too tightly in the closure since it must separate from the closure when secured to the container.

There remains a need therefore for an improved fitment which can be securely, temporarily retained in a conventional cap which requires no special retaining features.

There is an additional need for such a fitment which can be easily and economically manufactured and assembled with a closure having no specialized features for retaining the fitment.

There is still another need for such a fitment and fitment closure combination which can withstand the shocks of the conventional capping operation without separating.

SUMMARY OF THE INVENTION

These and other needs are satisfied by the invention which is directed to a dispensing fitment and an assembly of a dispensing fitment and a screw cap wherein the fitment has a circular end wall with at least one dispensing opening and a cylindrical sidewall with retaining means extending radially outward therefrom to engage the internal threads in the screw cap to temporarily retain the fitment so that the cap and the fitment may be applied to a container as an assembly in a single operation. As the fitment engages the threads of the screw cap, no modification is required to the cap for use with the fitment.

The retaining means includes thin flexible planar fin members extending outward from the sidewall of the fitment parallel to the end wall and into the thread on the cap. In addition, there are axial ribs extending radially outward from the sidewall of the fitment to engage the thread on the cap. The flexible planar fin members mechanically engage the thread to secure the fitment in the cap, and the axial ribs prevent tilting of the fitment which could cause disengagement of the flexible fins, and also provide some friction for retaining the fitment within the cap. Preferably, the ribs and the planar fin members are semicircular in cross-section and coaxial.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
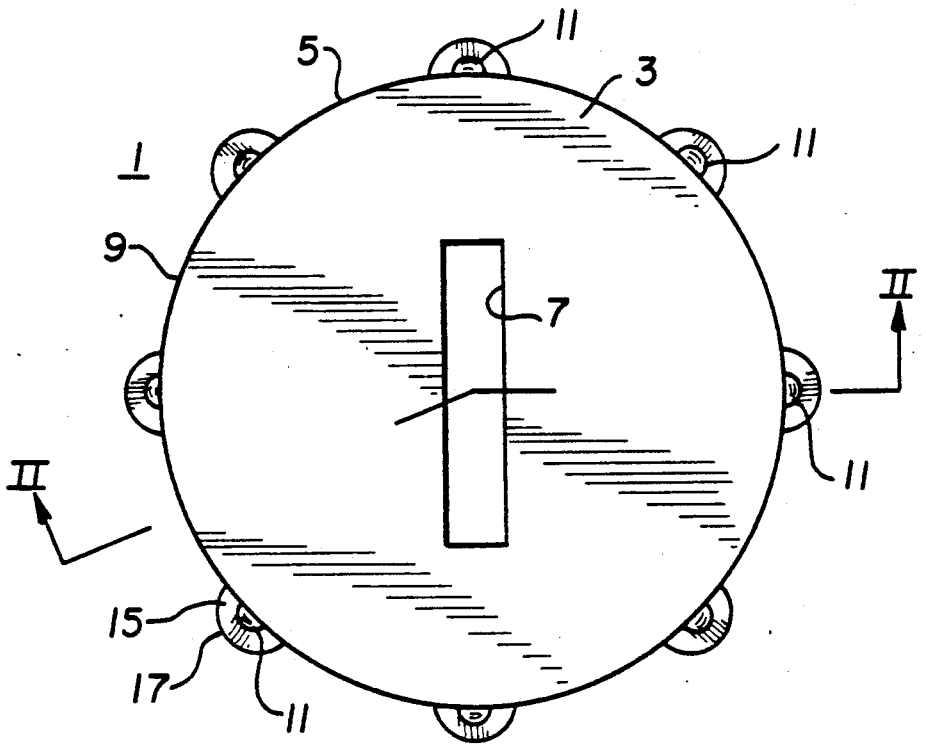
FIG. 1 is a top plan view of a fitment in accordance with the invention.
Figure 2:
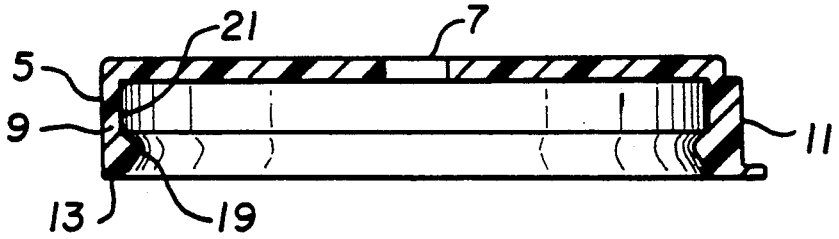
FIG. 2 is a vertical section through the fitment of FIG. 1 taken along the line II—II.

Referring to FIGS. 1 and 2, the fitment 1 and 2, in accordance with the invention has a circular end wall 3 and a cylindrical sidewall 5 extending axially from the periphery of the end wall 3. The end wall 3 has a dispensing slot 7 through which product can be dispensed from a container to which the fitment 1 is applied, as will be seen. Other types of dispensing openings other than the slot 7 can be provided in the end wall 3, for instance, a small opening for dispensing a liquid a drop at a time, or a plurality of openings through which the contents of a container can be shaken. Spaced angularly around the outer surface 9 of the cylindrical sidewall 5 are axially extending ribs 11. These ribs 11 which extend radially outward from the sidewall 5 are semicircular in cross-section. The ribs 11 extend from the free edge 13 of the sidewall 5 to a point about even with the inside surface of the end wall 3. (See FIG. 2) In the exemplary fitment 1, there are 8 ribs 11 spaced 45° apart, although other numbers of ribs can be utilized.

Extending radially outward from each of the ribs 11 at the free edge 13 of the sidewall 5 and parallel to the end wall 3, is a thin flexible planar fin number 15. These fins 15 have a curved outer edge 17 which in the exemplary embodiment of the invention is semicircular. An annular bead 19 extends radially inward from the inner surface 21 of the sidewall 5 adjacent the free edge 13.

Figure 3:
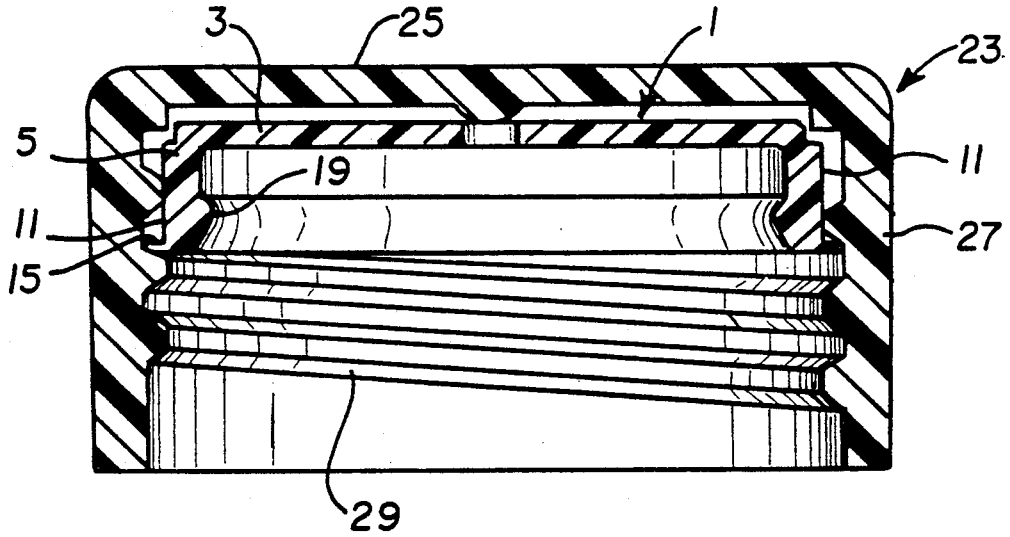
FIG. 3 is a vertical section through a screw cap with the fitment of FIGS. 1 and 2 retained in the cap in accordance with the invention.

Rather than applying the fitment 1 directly to a container, it is instead temporarily retained inside a screw cap 23 as illustrated in FIG. 3. The cap 23 has a circular end wall 25 and an annular skirt 27 which has an internal helical thread 29 for securing the cap to a container. The fitment 1 is pushed into the cap 23 with the fitment end wall 3 seating against the inner surface the cap end wall 25. The axial ribs 11 center the fitment within the cap and produce a friction fit with the threads 29 on the cap. In addition, the thin flexible planar fin members 15 extend radially outward into the thread 29. At least one of the fins 15 engages the top surface of the thread 29 to, together with the ribs 11, retain the fitment within the cap. As the thread 29 is helical and the free edge 13 of the sidewall of the fitment is square to the longitudinal axis 30 of the cap, others of the radial fins 15 extend into the gap 31 between the threads 29. However, since the ribs 11 extend outward to the thread 29, and thereby prevent the fitment 1 from tilting within the cap 23, the engagement of even one fin 15 with the top edge of the thread is sufficient to firmly retain the fitment 1 within the cap. The fins 15 are flexible enough that they can bend to pass over the threads as the fitment is pushed into the cap, yet they are stiff enough to provide the required retaining force.

Figure 4:
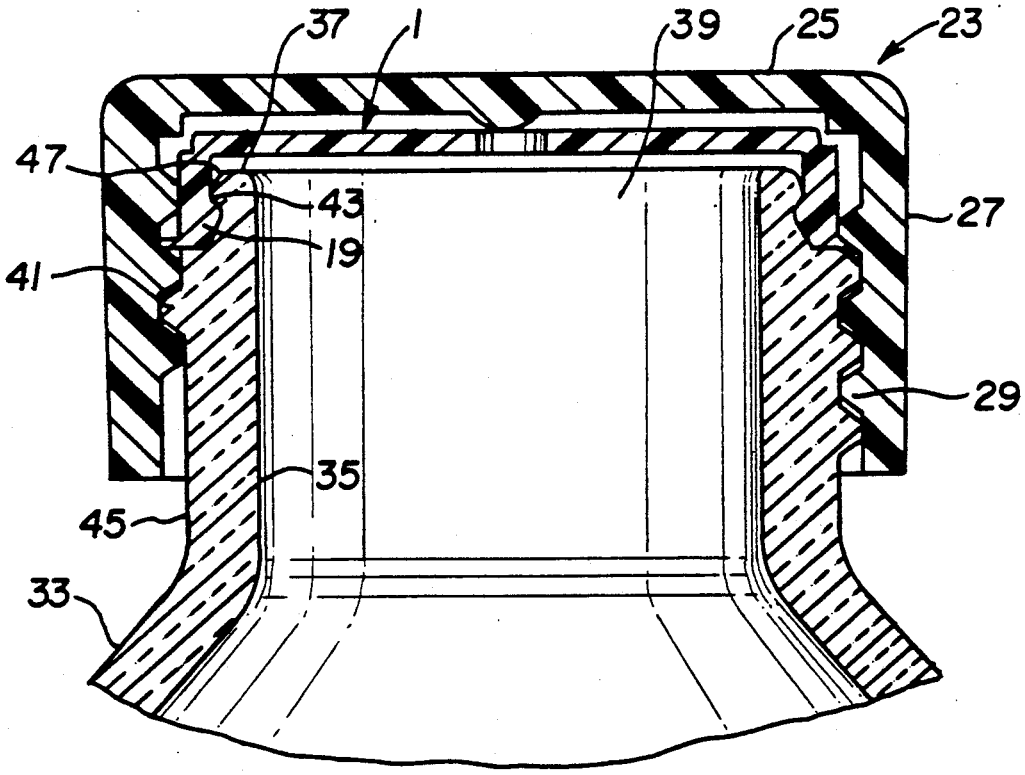
FIG. 4 is a vertical section similar to FIG. 3 illustrating the cap of FIG. 3 screwed onto a container with the fitment of FIGS. 1 and 2 secured to the container.

The cap 23 with the fitment 1 retained within by the ribs 11 and the thin planar fins 15 is applied as a unit to a container such as the bottle 33 as shown in FIG. 4. The bottle 33 has a neck 35 terminating in a rim 37 which defines an opening 39. A helical external thread 41 complimentary to the internal thread 29 on the cap is provided on the neck 35. Between the rim 37 and the external thread 41 is a radially inwardly extending annular groove 43 in the outer surface 45 of the neck. The outer surface of the neck tapers radially outward from the rim 37 to the groove 43, as shown at 47.

As the cap 23 is threaded onto to the neck 35 of the container 33, the locking bead 19 on the fitment 1 engages and is cammed outward by the tapered surface 47 and then snaps into engagement with the groove 43 to secure the fitment to the container neck.

When the cap 23 is unscrewed, the fitment remains attached to the container neck through the firm engagement between the locking bead 19 and the groove 43 in the container neck. The thin flexible fins 15 threadedly engage the internal thread 29 on the cap 23 to provide a positive axial separating force between the fitment and the unthreaded cap to help separate the cap from the fitment.

The fitment 1, in accordance with the invention securely engages the cap 23 merely by pressing the fitment into the cap. The fitment remains within the cap despite rough handling to which the assembly is exposed prior to application of the cap to a container. Still, the fitment is easily separated from the cap upon engagement with the container. The fitment 1 can be easily and economically manufactured using straight draw molds. A decided advantage of the fitment 1 in accordance with the invention is that it can be used with existing screw caps as no special features are required on the cap to retain the fitment temporarily in place.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. A dispensing fitment for use with a screw cap having a skirt with internal threads which thread onto an external thread on a container neck which also has fitment securing means, said dispensing fitment comprising:

a circular end wall having at least one dispensing opening therein, a cylindrical sidewall extending axially from said circular end wall and terminating in a free end, container engagement means on said sidewall, and retaining means comprising flexible planar members extending radially outward from said sidewall of the fitment substantially parallel to said end wall and engaging the internal threads in said cap, and ribs extending axially along the sidewall of the fitment and radially outward to contact said internal thread on said cap, said retaining means retaining said fitment within said cap until said cap is threaded onto said container neck and said container engagement means engages said fitment securing means to secure said fitment to said container neck when said cap is threaded off of said container neck.

2. The fitment of claim 1 wherein said flexible planar members extend radially outward from the sidewall of the fitment adjacent said free end.

3. The fitment of claim 2 wherein said flexible planar members are curved segments.

4. The fitment of claim 3 wherein said curved segments are semicircular segments.

5. The fitment of claim 1 wherein said flexible planar members extend radially outward adjacent said free end of said sidewall and are each angularly aligned with one of said axial ribs.

6. The fitment of claim 5 wherein said fitment securing means on said container neck comprises a radially inward annular groove in an outer surface of said container neck and wherein said container engaging means comprises an annular bead extending radially inward from the sidewall of said fitment.

7. In combination, a screw cap and a dispensing fitment for a container having a neck defining a container opening and having an external thread spaced from said opening and an external annular groove between said external thread and said container opening, said screw cap including a cylindrical skirt and an internal thread on said skirt for screwing said cap onto the thread on the neck of the container, and said dispensing fitment comprising a circular end wall with at least one dispensing opening therein, a cylindrical sidewall extending axially from said end wall and terminating in a free end, a plurality of axially extending ribs angularly distributed around said sidewall and extending radially outward to the internal threads on said skirt of said cap, planar flexible members extending radially outward from said sidewall adjacent said free end generally parallel to said end wall and into said internal thread on said cap skirt to retain said fitment in said cap, and an annular bead extending radially inward from the sidewall of the fitment and which engages the external groove on said neck of said container to secure said fitment to said container when said cap is screwed onto the container and to retain said fitment on said container even as said cap is unscrewed from the container.

8. The combination of claim 7 wherein said flexible planar members are curved segments and wherein said axially extending ribs are centered on said curved segment flexible planar members.

* * * * *